US010907509B2

(12) United States Patent
Hwang et al.

(10) Patent No.: US 10,907,509 B2
(45) Date of Patent: Feb. 2, 2021

(54) WASTE HEAT RECOVERY POWER GENERATION SYSTEM AND FLOW CONTROL METHOD THEREOF

(71) Applicant: DOOSAN HEAVY INDUSTRIES & CONSTRUCTION CO., LTD., Changwon-si (KR)

(72) Inventors: Jeong Ho Hwang, Daegu (KR); Eung Chan Lee, Seoul (KR); Seung Gyu Kang, Yongin-si (KR); Sang Sin Park, Chungcheongbuk-do (KR); Cheol Rae Jeong, Incheon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 284 days.

(21) Appl. No.: 15/177,790

(22) Filed: Jun. 9, 2016

(65) Prior Publication Data

US 2017/0234266 A1 Aug. 17, 2017

(30) Foreign Application Priority Data

Feb. 11, 2016 (KR) ..... 10-2016-0015475
Feb. 11, 2016 (KR) ..... 10-2016-0015476

(51) Int. Cl.

| | |
|---|---|
| ***F01K 13/02*** | (2006.01) |
| ***F01K 7/16*** | (2006.01) |
| ***F01K 7/32*** | (2006.01) |
| ***F01K 25/10*** | (2006.01) |

(52) U.S. Cl.

CPC ..... *F01K 13/02* (2013.01); *F01K 7/16* (2013.01); *F01K 7/32* (2013.01); *F01K 25/103* (2013.01)

(58) Field of Classification Search

CPC ..... F01K 13/02; F01K 25/103; F01K 7/16; F01K 7/32

See application file for complete search history.

(56) References Cited

U.S. PATENT DOCUMENTS

2009/0241543 A1* 10/2009 Ernst ..... F01K 9/04 60/645
2014/0102101 A1* 4/2014 Xie ..... F01K 25/103 60/647
2016/0003108 A1* 1/2016 Held ..... F01K 23/10 60/517

FOREIGN PATENT DOCUMENTS

JP 2012-145092 A 8/2012
KR 10-2015-0139859 A 12/2015

OTHER PUBLICATIONS

Communication dated Dec. 19, 2017 from the Korean Intellectual Property Office in counterpart Application No. 10-2016-0015475.

* cited by examiner

*Primary Examiner* — Matthew T Largi
(74) *Attorney, Agent, or Firm* — INVENSTONE Patent, LLC

(57) ABSTRACT

Provided is a waste heat recovery power generation system, including: a compressor configured to compress a working fluid; a heat exchanger configured to recover waste heat from waste heat gas supplied from a waste heat source, the recovered waste heat heating the working fluid; a turbine configured to be driven by the working fluid heated by the recovered waste heat; and a recuperator configured to exchange heat between an output fluid of the turbine and an output fluid of the compressor to cool the output fluid of the turbine in which the output fluid of the compressor is branched into a first output fluid and a second output fluid of the compressor.

13 Claims, 12 Drawing Sheets

WASTE HEAT RECOVERY POWER GENERATION SYSTEM AND FLOW CONTROL METHOD THEREOF

CROSS-REFERENCE TO RELATED APPLICATIONS

This application claims priority from Korean Patent Application No. 10-2016-0015475 and Korean Patent Application No. 10-2016-0015476, respectively filed on Feb. 11, 2016 the disclosures of which are incorporated herein by reference in their entireties.

BACKGROUND

1. Field

Apparatuses and methods consistent with exemplary embodiments relate to a waste heat recovery power generation system and a flow control method thereof, and more particularly, to a waste heat recovery power generation system and a flow control method thereof capable of coping with a change in temperature and flow of a waste heat source without changing an overall flow of the system by controlling a branch amount of a working fluid to control a waste heat recovery amount.

2. Description of the Related Art

As a demand for efficient power production is increasing internationally and activities for reducing the generation of pollutants are getting initiated, various efforts to increase power production while reducing the generation of pollutants have been conducted. As one of the efforts, research and development for a power generation system using supercritical $CO_2$ as a working fluid as disclosed in Japanese Patent Laid-Open Publication No. 2012-145092 has been actively conducted.

The supercritical $CO_2$ has a density similar to a liquid state and viscosity similar to gas, such that apparatuses may be miniaturized and power consumption required to compress and circulate a fluid may be minimized. Meanwhile, the supercritical $CO_2$ has critical points of 31.4° C. and 72.8 atmosphere and the critical points of the supercritical $CO_2$ are even lower than water having critical points of 373.95° C. and 217.7 atmosphere. Therefore, due to such low critical points, the supercritical $CO_2$ may very easily be handled. The power generation system using supercritical $CO_2$ shows pure power generation efficiency of about 45% when being operated at 550° C. and has a 20% increase in power generation efficiency compared to the existing steam cycle and reduces a size of a turbo apparatus by 10X.

When a plurality of heat sources, in which the temperature or flow of the waste heat source is changed, are incorporated, the system configuration is complicated and it is difficult to effectively use heat from the plurality of heat sources, and as a result most of the power generation systems using supercritical $CO_2$ use a single heater as a heat source. Therefore, there is a problem in that the system configuration is constrained and it is difficult to effectively use the heat source. Further, there is a problem in that it is difficult to effectively cope with the change in temperature and flow of the waste heat source.

SUMMARY

One or more exemplary embodiments provide a waste heat recovery power generation system and a flow control method thereof capable of coping with a change in temperature and flow of a waste heat source without changing an overall flow of the system by controlling a branch amount of a working fluid to control a waste heat recovery amount.

Other objects and advantages of the disclosure can be understood by the following description, and become apparent with reference to the one or more exemplary embodiments. Also, it is obvious to those skilled in the art to which the disclosure pertains that the objects and advantages of the inventive concept can be realized by the means as claimed and combinations thereof.

In accordance with an aspect of an exemplary embodiment, there is provided a waste heat recovery power generation system, including: a compressor configured to compress a working fluid; a plurality of heat exchanger configured to recover waste heat from waste heat gas supplied from a waste heat source to heat the working fluid; a turbine configured to be driven by the working fluid heated by passing through the heat exchanger; and a recuperator configured to exchange heat between the working fluid passing through the turbine and the working fluid passing through the compressor to cool the working fluid passing through the turbine, in which a flow of the working fluid passing through the compressor is branched from a latter end of the compressor.

The heat exchanger may include a first heat exchanger and a second heat exchanger, the first heat exchanger may be disposed at a low temperature side which is an emission end to which the waste heat gas is emitted, and the second heat exchanger may be disposed at a high temperature side which is an introduction end into which the waste heat gas is introduced.

The flow of the working fluid branched from a latter end of the compressor may be transferred to the first heat exchanger and the recuperator and the working fluid passing through the recuperator may be transferred to the second heat exchanger.

The waste heat recovery power generation system may further include: a mixer configured to be disposed at a front end of the second heat exchanger for the flow mixing of the working fluid and a separator configured to be disposed at the latter end of the compressor for the branch of the flow of the working fluid, in which the flow of the working fluid heated by passing through the first heat exchanger may be joined with the flow of the working fluid passing through the recuperator from the front end of the second heat exchanger.

The waste heat recovery power generation system may further include: a power generator configured to be connected to the turbine to produce power; and a gear box configured to be disposed between the turbine and the power generator to change an output of the turbine to correspond to an output frequency of the power generator and transfer the output to the power generator, in which the turbine and the compressor may be connected coaxially and the compressor and the power generator may be driven by the turbine.

The recuperator may include a first recuperator and a second recuperator, the second recuperator may be a high temperature recuperator into which the working fluid passing through the turbine is introduced, and the first recuperator may be a low temperature recuperator into which the working fluid passing through the second recuperator is introduced.

The recuperator to which the working fluid branched from the latter end of the compressor is transferred may be the first recuperator and the flow of the working fluid heated by passing through the first heat exchanger may be joined with the flow of the working fluid passing through the second recuperator from the front end of the second heat exchanger.

The mixer disposed at the front end of the second heat exchanger may be a first mixer and may further include a second mixer disposed between the first recuperator and the second recuperator and may further include a second separator disposed between the first mixer and the second heat exchanger to branch the flow of the working fluid passing through the first mixer into the second heat exchanger or the turbine.

The turbine may include a first turbine supplied with the working fluid by the second separator and a second turbine supplied with the working fluid by the second heat exchanger and connected to the first turbine in parallel and a temperature of the working fluid transferred to the first turbine may be relatively lower than a temperature of the working fluid transferred to the second turbine.

The working fluid passing through the first turbine may be introduced into the second mixer and the working fluid passing through the second turbine may be mixed with the working fluid passing through the first turbine from the second mixer through second recuperator and then may be transferred to the first recuperator.

The waste heat recovery power generation system may further include a storage tank additionally supplying the working fluid, in which a flow measurer may be disposed at a front end of the compressor and a front end of the first heat exchanger and a flow control valve controlling the flow of the working fluid may be disposed between the first separator and the first recuperator, an emission end of the first heat exchanger, and an emission end of the second heat exchanger, respectively.

In accordance with an aspect of an exemplary embodiment, there is provided a flow control method of a waste heat recovery power generation system including the components of the waste heat recovery power generation system, including: controlling the flow control valve disposed at the emission end of the first heat exchanger depending on a temperature of a final outlet of the first heat exchanger to control the flow of the working fluid to correspond to the temperature of the final outlet of the first heat exchanger.

If the temperature of the final outlet of the first heat exchanger is higher than a temperature of a preset emission regulation condition, the flow control valve disposed at the emission end of the first heat exchanger may be opened to increase the flow of the working fluid to reduce the temperature of the final outlet of the first heat exchanger and if the temperature of the final outlet of the first heat exchanger is lower than the preset emission regulation condition temperature, the flow control valve disposed at the emission end of the first heat exchanger may be closed to cut off the flow of the working fluid to constantly maintain the temperature of the final outlet of the first heat exchanger.

If a heat value supplied from the waste heat source is increased and thus the flow of the working fluid needs to be increased, the flow measurer may measure the flow of the working fluid and then the flow control valve of the latter end of the first heat exchanger may be closed to cut off the flow of the working fluid to constantly maintain the temperature of the final outlet of the first heat exchanger and the flow control valve disposed between the first separator and the first recuperator may be opened to increase the flow of the working fluid.

If the heat value supplied from the waste heat source is reduced and thus the flow of the working fluid needs to be reduced, the flow measurer may measure the flow of the working fluid and then the flow control valve of the latter end of the first heat exchanger may be closed to cut off the flow of the working fluid to constantly maintain the temperature of the final outlet of the first heat exchanger and the flow control valve disposed between the first separator and the first recuperator may be closed to reduce the flow of the working fluid.

Upon abnormality of the first heat exchanger and the second turbine, the flow of the working fluid transferred from the second separator to the second heat exchanger may be cut off to supply the working fluid mixed by the first mixer only to the first turbine.

Upon the abnormality of the first turbine, the flow of the working fluid transferred from the second separator to the first turbine may be cut off to supply the working fluid mixed by the first mixer only to the second turbine.

Upon the abnormality of the first heat exchanger, the flow of the working fluid transferred from the first separator to the first heat exchanger may be cut off to supply the working fluid passing through the compressor only to the first recuperator.

The working fluid passing through the second recuperator may be branched into the second heat exchanger and the first turbine through the second separator.

The flow of the working fluid transferred from the second separator to the first turbine may be cut off to supply the working fluid passing through the second recuperator to the second heat exchanger through the second separator and then may be transferred to the second turbine.

It is to be understood that both the foregoing general description and the following detailed description of the present invention are exemplary and explanatory and are intended to provide further explanation of the invention as claimed.

In accordance with an aspect of an exemplary embodiment, there is provided a waste heat recovery power generation system, including: a compressor configured to compress a working fluid; a heat exchanger configured to recover waste heat from waste heat gas supplied from a waste heat source, the recovered waste heat heating the working fluid; a turbine configured to be driven by the working fluid heated by the recovered waste heat; and a recuperator configured to exchange heat between an output fluid of the turbine and an output fluid of the compressor to cool the output fluid of the turbine, wherein the output fluid of the compressor is branched into a first output fluid and a second output fluid of the compressor.

The heat exchanger may include: a first heat exchanger; and a second heat exchanger, in which the first heat exchanger is disposed at a low temperature side of the heat exchanger to receive the first output fluid of the compressor, and the second heat exchanger is disposed at a high temperature side of the heat exchanger to receive the waste heat gas from the waste heat source.

The first output fluid branched from the output fluid of the compressor may be transferred to the first heat exchanger, in which the second output fluid branched from the output fluid of the compressor may be transferred to the recuperator, and the second output fluid passing through the recuperator is transferred to the second heat exchanger.

The waste heat recovery power generation system may further include: a first mixer configured to be disposed between the first heat exchanger and the second heat exchanger and configured to mix an output fluid of the first heat exchanger and the second output fluid passing through the recuperator; and a first separator configured to be disposed at a downstream side of the compressor and configured to branch the output fluid of the compressor into the first output fluid and the second output fluid of the compressor, wherein the output fluid of the first heat exchanger is joined with the second output fluid passing through the recuperator at an upstream side of the second heat exchanger.

The waste heat recovery power generation system may further include a power generator connected to the turbine and configured to produce power; and a gear box disposed between the turbine and the power generator, configured to change an output of the turbine according to an output frequency of the power generator and configured to transfer the output of the turbine to the power generator, wherein the turbine and the compressor are connected coaxially, and wherein the compressor and the power generator are driven by the turbine.

The recuperator may include: a first recuperator; and a second recuperator, wherein the second recuperator comprises a high temperature recuperator configured to receive the output fluid of the turbine is introduced, and wherein the first recuperator comprises a low temperature recuperator configured to receive an output fluid of the second recuperator.

The first recuperator may be configured to receive the second output fluid of the compressor and the output fluid of the first heat exchanger may be joined with the second output fluid passing through the second recuperator at an upstream side of the second heat exchanger.

The waste heat recovery power generation system may further include: a second mixer disposed between the first recuperator and the second recuperator, and a second separator disposed between the first mixer and the second heat exchanger and configured to branch an output fluid of the first mixer into a third output fluid and a fourth output fluid.

The turbine may include: a first turbine configured to receive the third output fluid from the second separator; and a second turbine connected in parallel with the first turbine and configured to receive an output fluid of the second heat exchanger, and wherein a temperature of the third output fluid transferred to the first turbine is relatively lower than a temperature of the output fluid of the second heat exchanger transferred to the second turbine.

The third output fluid passing through the first turbine may be introduced into the second mixer, and the output fluid of the second heat exchanger passing through the second turbine may be mixed with the third output fluid passing through the first turbine from the second mixer through second recuperator and then is transferred to the first recuperator.

The waste heat recovery power generation system may further include: a storage tank configured to supply an additional working fluid; a flow measurer is disposed at an upstream side of the compressor and an upstream side of the first heat exchanger; and a plurality of flow control valves disposed between the first separator and the first recuperator, disposed at an emission end of the first heat exchanger, and disposed at an emission end of the second heat exchanger, respectively and configured to control a flow the working fluid.

In accordance with an aspect of an exemplary embodiment, there is provided a method of controlling a flow of the working fluid in the waste heat recovery power generation system including controlling a flow control valve of the plurality of flow control valves disposed at the emission end of the first heat exchanger to control the flow of the working fluid according to a temperature of a final outlet of the first heat exchanger.

The controlling the flow control valve may include: if the temperature of the final outlet of the first heat exchanger is higher than a temperature of a preset emission regulation condition, opening the flow control valve disposed at the emission end of the first heat exchanger to increase the flow of the working fluid to reduce the temperature of the final outlet of the first heat exchanger; and if the temperature of the final outlet of the first heat exchanger is lower than the preset emission regulation condition temperature, closing the flow control valve disposed at the emission end of the first heat exchanger to cut off the flow of the working fluid to constantly maintain the temperature of the final outlet of the first heat exchanger.

The controlling the flow control valve may include if a heat value supplied from the waste heat source is increased thereby requiring the flow of the working fluid to be increased, i) measuring the flow measurer is the flow of the working fluid, ii) constantly maintaining the temperature of the final outlet of the first heat exchanger, and iii) opening the flow control valve disposed between the first separator and the first recuperator to increase the flow of the working fluid.

The controlling the flow control valve may include if a heat value supplied from the waste heat source is reduced thereby requiring the flow of the working fluid needs to be reduced, i) measuring the flow of the working fluid, ii) maintaining the temperature of the final outlet of the first heat exchanger and iii) closing the flow control valve disposed between the first separator and the first recuperator to reduce the flow of the working fluid.

If abnormality of the first heat exchanger and the second turbine is determined, cutting off the flow of the working fluid transferred from the second separator to the second heat exchanger to supply the working fluid mixed by the first mixer only to the first turbine.

If abnormality of the first turbine is determined, cutting off the flow of the working fluid transferred from the second separator to the first turbine to supply the working fluid mixed by the first mixer only to the second turbine.

If abnormality of the first heat exchanger is determined, cutting off the flow of the working fluid transferred from the first separator to the first heat exchanger to supply the working fluid passing through the compressor only to the first recuperator.

The working fluid passing through the second recuperator may be branched to be transferred into the second heat exchanger and the first turbine through the second separator.

The flow of the working fluid transferred from the second separator to the first turbine may be cut off thereby the flow of the working fluid transferred from the second separator being supplied the working fluid passing through the second recuperator to the second heat exchanger through the second separator and then the flow of the working fluid transferred from the second separator is transferred to the second turbine.

BRIEF DESCRIPTION OF THE DRAWINGS

The above and/or other objects, features and other advantages of the disclosure will be more clearly understood from the following detailed description taken in conjunction with the accompanying drawings, in which.

DETAILED DESCRIPTION

Hereinafter, a power generation system using supercritical $CO_2$ according to an exemplary embodiment will be described in detail with reference to the accompanying drawings.

In the related art, the power generation system using supercritical $CO_2$ operates in a closed cycle in which $CO_2$ used for power generation is not emitted to the outside and uses supercritical $CO_2$ as a working fluid.

The power generation system using supercritical $CO_2$ as the working fluid may use exhaust gas emitted from a thermal power plant, etc., such that the exhaust may be used in a single power generation system and a hybrid power generation system with a thermal power generation system. The working fluid of the power generation system using supercritical $CO_2$ may also supply $CO_2$ separated from the exhaust gas and may also supply separate $CO_2$ to the power generation system.

The $CO_2$ within the cycle is in a high temperature and high pressure supercritical state and a supercritical $CO_2$ fluid drives a turbine. The turbine is connected to a power generator or a pump, in which the turbine connected to the power generator produces power and the pump is driven by the turbine connected to the pump. The $CO_2$ passing through the turbine is cooled while passing through a heat exchanger and the cooled working fluid ($CO_2$) is again supplied to the compressor to be circulated within the cycle. The turbine or the heat exchanger may be provided in plural.

The present inventive concept of the disclosure provides a power generation system including a plurality of heaters and using supercritical $CO_2$ where the power generation system uses waste heat gas as a heat source and operates the number of recuperators which is smaller than or equal to the number of heat sources by effectively disposing each heat exchanger within the power generation system depending on conditions such as temperature of an inlet and an outlet, capacity, and the number of heat sources.

The power generation system using supercritical $CO_2$ according to exemplary embodiments may include any system that all the working fluids flowing within the cycle are in the supercritical state and a system that most of the working fluids are in the supercritical state and the rest of the working fluids are in a subcritical state.

Further, according to exemplary embodiments, the $CO_2$ is used as the working fluid. Here, the $CO_2$ may include pure $CO_2$ in a chemical meaning, $CO_2$ somewhat including impurities in general terms, and a fluid in a state in which more than one fluid as additives is mixed with $CO_2$.

Figure 1:
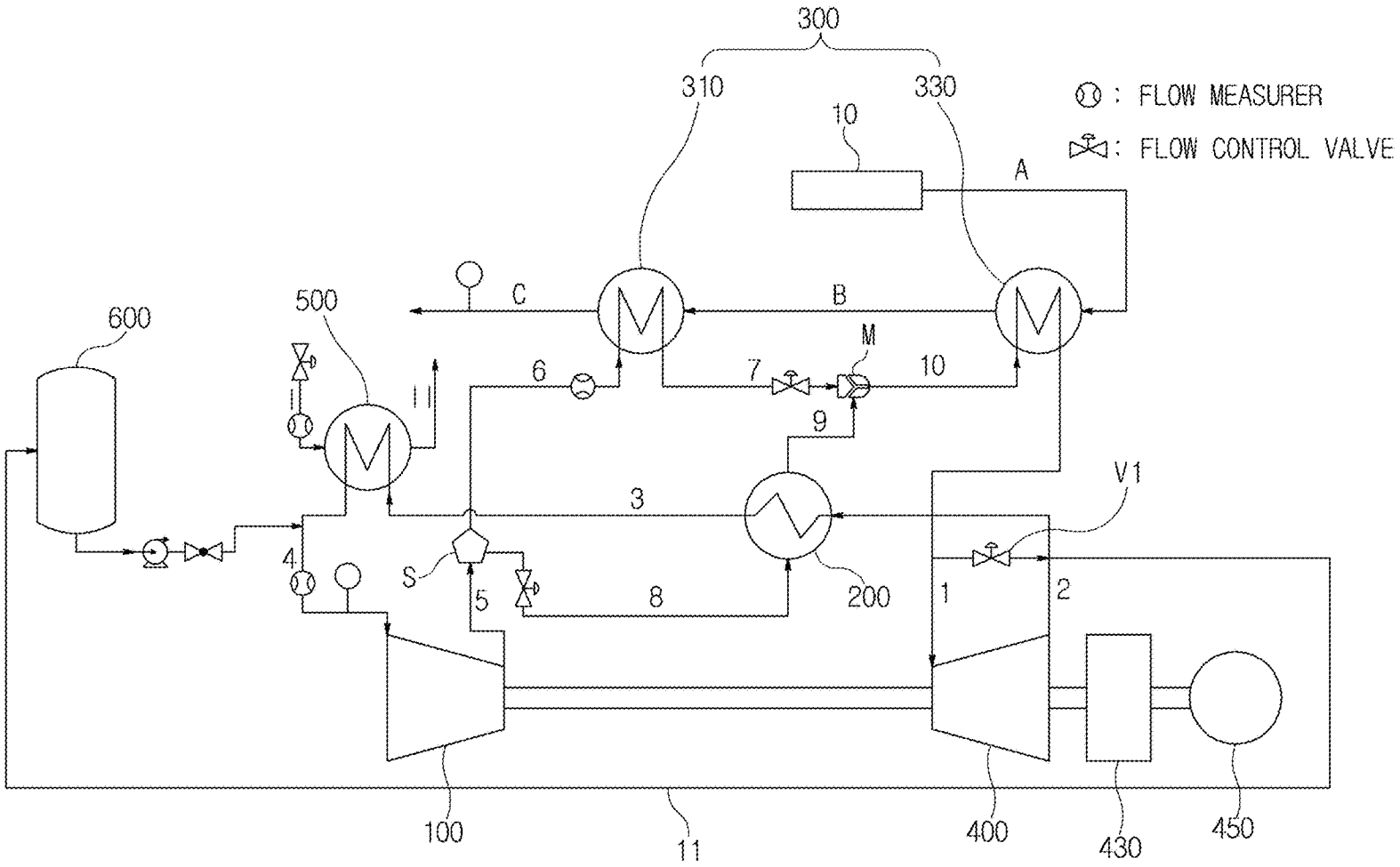
FIG. 1 is a schematic diagram illustrating a waste heat recovery power generation system according to an exemplary embodiment.

FIG. 1 is a schematic diagram illustrating a waste heat recovery power generation system according to an exemplary embodiment.

As illustrated in FIG. 1, a double waste heat power generation system according to an exemplary embodiment may be configured to include a compressor 100 compressing the working fluid, a plurality of recuperators 200 and a plurality of heat sources 300 exchanging heat with the working fluid passing through the compressor 100, a plurality of turbines 400 driven by the working fluid heated by passing through the recuperators 200 and the heat sources 300, a power generator 450 driven by the turbines 400, and a cooler 500 cooling the working fluid introduced into the compressor 100.

Each of the components of the exemplary embodiment is connected by a transfer tube (streams Nos. 1 to 12 of FIGS. 1 to 4) in which the working fluid flows. Although not specially mentioned, it is to be understood that the working fluid flows along the transfer tube. However, when a plurality of components are integrated, the integrated configuration may be a part or an area serving as the transfer tube actually. Therefore, even in this case, it is to be understood that the working fluid flows along the transfer tube. A channel performing a separate function will be described additionally.

The compressor 100 is driven by the turbine 400 to be described below and serves to transfer (streams 5 and 8) the low-temperature working fluid cooled by passing through (stream 4) the cooler 500 to the recuperator 200. The latter end of the compressor 100 is provided with a separator S for distributing a flow of the working fluid passing through the compressor 100.

The separator S serves to branch (streams Nos. 6 and 8) the flow passing through the compressor 100 into one of the heat sources 300 to be described below and the recuperator 200 to be described below. Some of the flow of the working fluid is branched from the latter end of the compressor 100 which is the lowest temperature in the power generation system to be transferred (stream 6) to the heat source 300 recovering waste heat and used for heat exchange, thereby maximally maintaining an absorbed amount of the waste heat (flow distribution of the working fluid and the flow control will be described below).

The recuperator 200 serves to exchange heat between a working fluid (stream 2) cooled from high temperature to middle temperature while being expanded by passing through the turbine 400 and a working fluid (stream 8) passing through the recuperator 200 via the compressor 100 to be described below. The recuperator 200 is installed on the transfer tube branched by the separator S and is disposed between (stream 3) an emission end of the turbine 400 and an introduction end of the cooler 500. The working fluid passing through the compressor 100 from the recuperator 200 is primarily heated by the working fluid passing through the turbine 400.

The working fluid primarily cooled by the heat exchange in the recuperator 200 is transferred to the cooler 500 to be secondarily cooled (stream 3) and is then transferred (stream 4) to the compressor 10. The working fluid primarily heated by the heat exchange in the recuperator 200 is supplied to the heat source 300 to be described below.

The heat source 300 may be configured of a constrained heat source in which an emission condition of emitted gas is defined and a general heat source in which the emission condition of the emitted gas is not defined. In the present specification, for convenience, an example in which a first heat exchanger 310 is configured of the constrained heat source and a second heat exchanger 330 is configured of the general heat source will be described.

The second heat exchanger 330 is disposed at a side near the waste heat source 10 and the first heat exchanger 310 is disposed at a side relatively farther away from the waste heat source, compared to the second heat exchanger 330.

The first heat exchanger 310 uses gas (hereinafter, waste heat gas) having waste heat like exhaust gas of other power generation cycle as the heat source and is a heat source having an emission regulation condition upon the emission (C) of the waste heat gas. The emission regulation condition is a temperature condition, and the temperature of the waste heat gas introduced into the first heat exchanger 310 is relatively lower than that of the waste heat gas introduced into the second heat exchanger 330 to be described below. The reason is that a distance from the waste heat source is relatively far.

The first heat exchanger 310 heats the working fluid passing through the compressor 100 and introduced (stream 6) into the first heat exchanger 310 with the heat of the waste heat gas. The waste heat gas from which the heat is taken away by the first heat exchanger 310 is cooled at a temperature meeting the emission regulation condition and then exits (C) the first heat exchanger 310. The absorbed amount of the waste heat is changed depending on how much a flow of a cooling fluid is transferred to the first heat exchanger 310. The working fluid heated by passing through the first heat exchanger 310 is supplied (stream 10) to the first heat exchanger 310 while being mixed (stream No. 7) with the working fluid primarily heated by passing through the recuperator 200 from the latter end of the recuperator 200.

The second exchanger 330 exchanges heat between the waste heat gas and the working fluid to serve to heat the working fluid and is a heat source without the emission regulation condition. The temperature of the waste heat gas introduced (A) into the second heat exchanger 330 is relatively higher than that of the waste heat gas introduced into the first heat exchanger 310. The reason is that the second heat exchanger 330 is disposed at a relatively close distance from the waste heat source.

A flow of a working fluid in which the working fluid passing through the recuperator 200 is mixed with the working fluid heated by the first heat exchanger 310 is introduced into the second heat exchanger 330. For the mixing of the working fluids, a mixer M is installed between the first heat exchanger 310 and the second heat exchanger 330. The mixer M is provided at a joint point of stream 9 and the stream 10. The second heat exchanger 330 heats the working fluid of the mixed flow. The working fluid heated by the second heat exchanger 330 is supplied (stream 1) to the turbine 400.

The flow introduced into the second heat exchanger 330 is a flow obtained by again summing two streams first branched from the latter end of the compressor 100, and therefore the overall flow of the power generation system is introduced into the second heat exchanger 330. Therefore, the flow introduced into the turbine 400 corresponds to an overall flow and even though the flow of the working fluid is branched from the latter end of the compressor 100, the overall flow introduced into the turbine 400 may remain unchanged.

The turbine 400 is driven by the working fluid and drives the power generator 450 to serve to produce power. The working fluid is expanded while passing through the turbine 400, and therefore the turbine 400 also serves as an expander.

Further, if the turbine 400 and the compressor 100 are designed to have the same speed, the turbine 400 and the compressor 100 are designed to be a co-axis, such that the turbine 400 may drive the power generator 450 and the compressor 100 at the same time. In this case, the turbine 400 needs to be rotated at RPM corresponding to an output frequency of the power generator 450 but may not be rotated at the RPM corresponding to the output frequency of the power generator 450 when the turbine 400 and the compressor 100 are designed to be a co-axis. Therefore, a gear box, a torque converter 430, or the like are provided between the turbine 400 and the power generator 450, such that the output of the turbine 400 may be converted to correspond to the output frequency of the power generator 450 and supplied.

In the waste heat recovery power generation system according to the exemplary embodiment having the foregoing configuration, a method for controlling a flow of a working fluid to cope with a change in temperature and flow of a waste heat source will be described.

Figure 3:
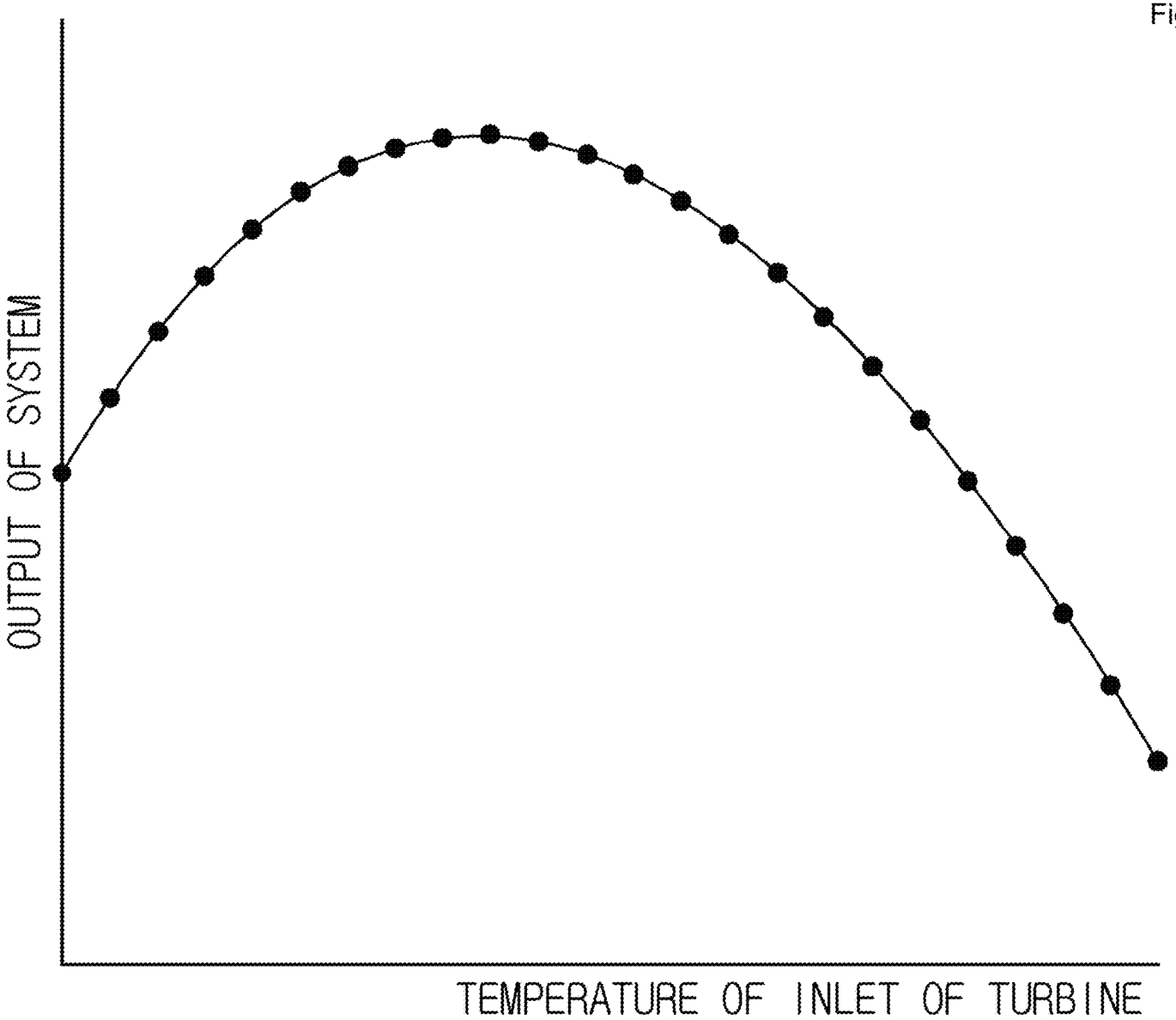
FIG. 3 is a graph illustrating an example of a temperature of an inlet of a turbine and an output of a system of the waste heat recovery power generation system of FIG. 1.
Figure 4:
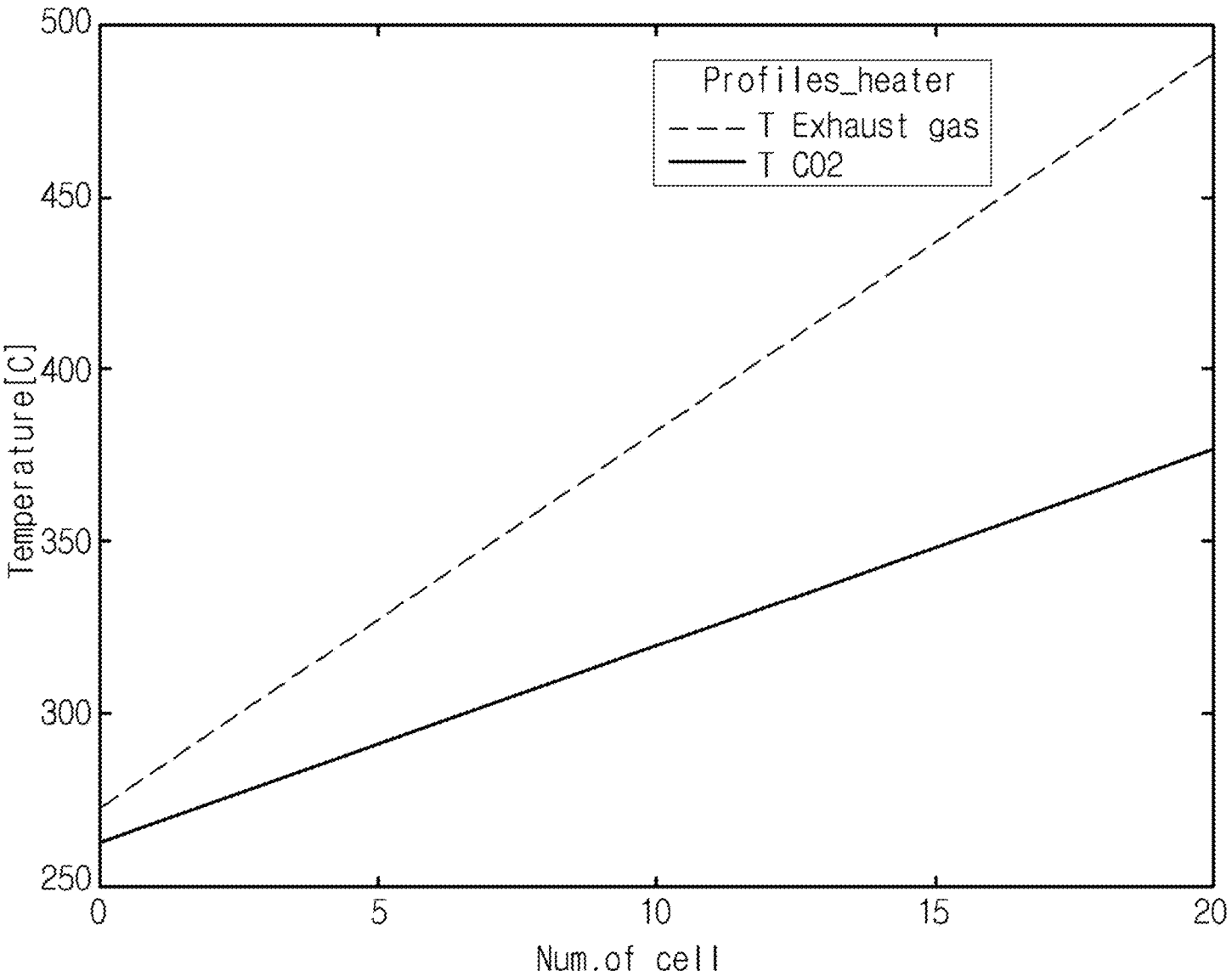
FIG. 4 is a graph illustrating a temperature distribution in a high temperature waste heat recovery heater of the waste heat recovery power generation system of FIG. 1.
Figure 5:
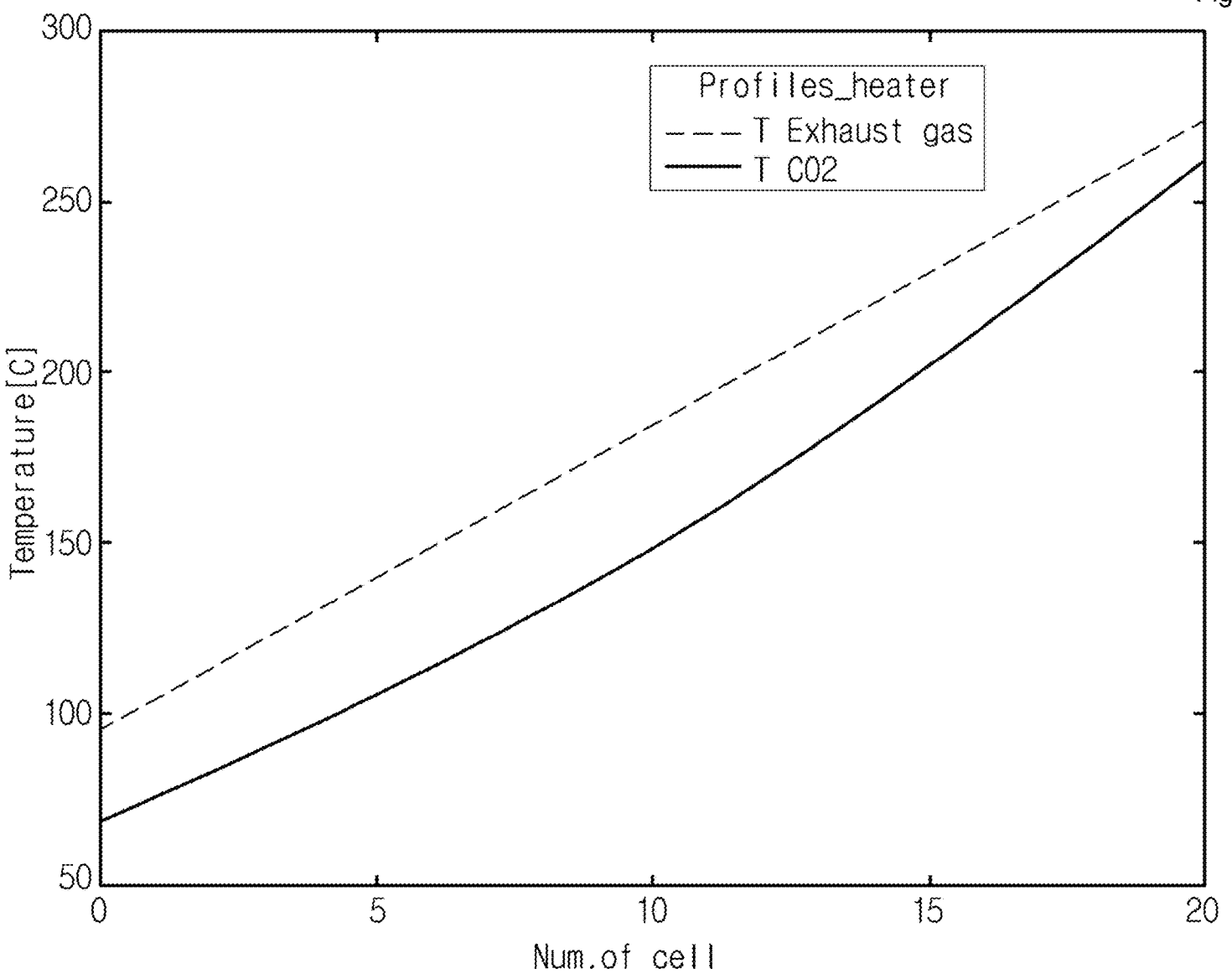
FIG. 5 is a graph illustrating a temperature distribution in a low temperature waste heat recovery heater of the waste heat recovery power generation system of FIG. 1.

FIG. 3 is a graph illustrating an example of a temperature of an inlet of a turbine and an output of a system of the waste heat recovery power generation system of FIG. 1, FIG. 4 is a graph illustrating a temperature distribution in a high temperature waste heat recovery heater of the waste heat recovery power generation system of FIG. 1, and FIG. 5 is a graph illustrating a temperature distribution in a low temperature waste heat recovery heater of the waste heat recovery power generation system of FIG. 1.

First, as illustrated in FIG. 1, in the waste heat recovery power generation system according to the exemplary embodiment, flow measurers for measuring a flow may each be installed at an inlet (stream 4) of the compressor 100 and an introduction end (stream 6 stream) of the first heat exchanger 310 which is a high temperature heat source.

Further, a flow control valve may be installed at a front end (stream 7) of the mixer M between the first heat exchanger 310 and the high temperature second heat exchanger 330 and may be installed between (stream 8) the separator S and the recuperator 200.

The flow control valve installed at the stream 7 measures a temperature of a final outlet (C stream) of the heat source, and thus is open to maximally absorb heat depending on the measured temperature. That is, if the temperature of the C stream is higher than that of the emission regulation temperature, the flow control valve of the stream 7 is controlled to be open and thus the flow of the working fluid transferred to the first heat exchanger 310 is increased, thereby reducing the temperature of the C stream. On the contrary, if the temperature of the C stream is lower than that of the emission regulation temperature, the flow control valve is controlled to be closed and thus the working fluid transferred to the first heat exchanger 310 is cut off, thereby constantly maintaining the temperature of the C stream. By this process, the temperature of the C stream may be constantly maintained.

Further, the flow control valve is installed at the stream 7 to control the pressure of the valve, and as a result it is possible to prevent the working fluid of the stream 9 from the recuperator 200 toward the mixer M from reflowing in the stream 7.

Meanwhile, a heat value supplied from the heat source is increased, and thus there may be the case in which the overall flow of the system needs to be increased.

In this case, the flow of the working fluids of streams Nos. 4 and 6 is measured and then the flow control valve of the stream 7 constantly maintains the temperature of the C stream. At the same time, the flow control valve installed at the stream 8 is open, and as a result the overall flow of the power generation system may be increased. A separate working fluid storage tank is provided due to the insufficient flow of the working fluid and the working fluid is supplied from the storage tank into the power generation system as much as the insufficient flow.

On the contrary, the heat value supplied from the heat source is insufficient, and thus there may be the case in which the overall flow of the system needs to be decreased.

In this case, the flow of the working fluid of the stream 6 is measured and then the flow control valve of the stream 7 constantly maintains the temperature of the C stream. At the same time, the flow control valve installed at the stream 8 is closed, and as a result the overall flow of the power generation system may be decreased. To this end, a bypass valve V1 is provided between the inlet and the outlet of the turbine 400 and the bypass valve V1 may be preferably connected to the storage tank 600 through the separate transfer tube 11. If the bypass valve V1 is operated, the working fluid passing through the second heat exchanger 330 is not transferred to the turbine 400 but is recovered to the storage tank 600 through the separate transfer tube 11.

In connection with the control of the flow of the working fluid as described above, to constantly maintain the temperature of the inlet of the compressor 100, the flow of the cooler 500 may also be controlled.

The relationship between the output and the temperature of the system by controlling the flow of the working fluid according to the foregoing flow control method will be briefly described below.

As illustrated in FIG. 3, if the heat value given to the system is constant (when the temperature of the C stream is constantly maintained), when the overall flow is increased upon the design of the system, the temperature of the inlet of the turbine 400 is reduced and when the overall flow is decreased, the temperature of the inlet of the turbine 400 is increased. Depending on the correlation, a maximum output of the whole system may be changed according to characteristics of the heat source but an optimal design point is present (for example, if the temperature of the heat source is 490° C., there is the optimal design point before and after about 370° C.).

Generally, if the temperature of the inlet of the turbine 400 is increased, the output of the whole system is increased but even though the temperature of the inlet of the turbine 400 is low in characteristics of the power generation cycle using supercritical $CO_2$, by the increase in the flow, the optimal design point suitable for the increase in the output of the system is present.

The temperature different may be different according to the characteristics of the heat source, but for example, the temperature difference between the waste heat gas and the working fluid in the second heat exchanger 330 may show a distribution as illustrated in FIG. 4 and the temperature difference between the waste heat gas and the working fluid in the first heat exchanger 310 may show a distribution as illustrated in FIG. 5.

Considering the correlation, according to the exemplary embodiment, the smaller the temperature of the working fluid between the first heat exchanger 310 and the second heat exchanger 330, the higher the overall efficiency of the system. For example, according to the exemplary embodiment, having the temperature of about 10° C. may be the optimal design point.

Figure 2:
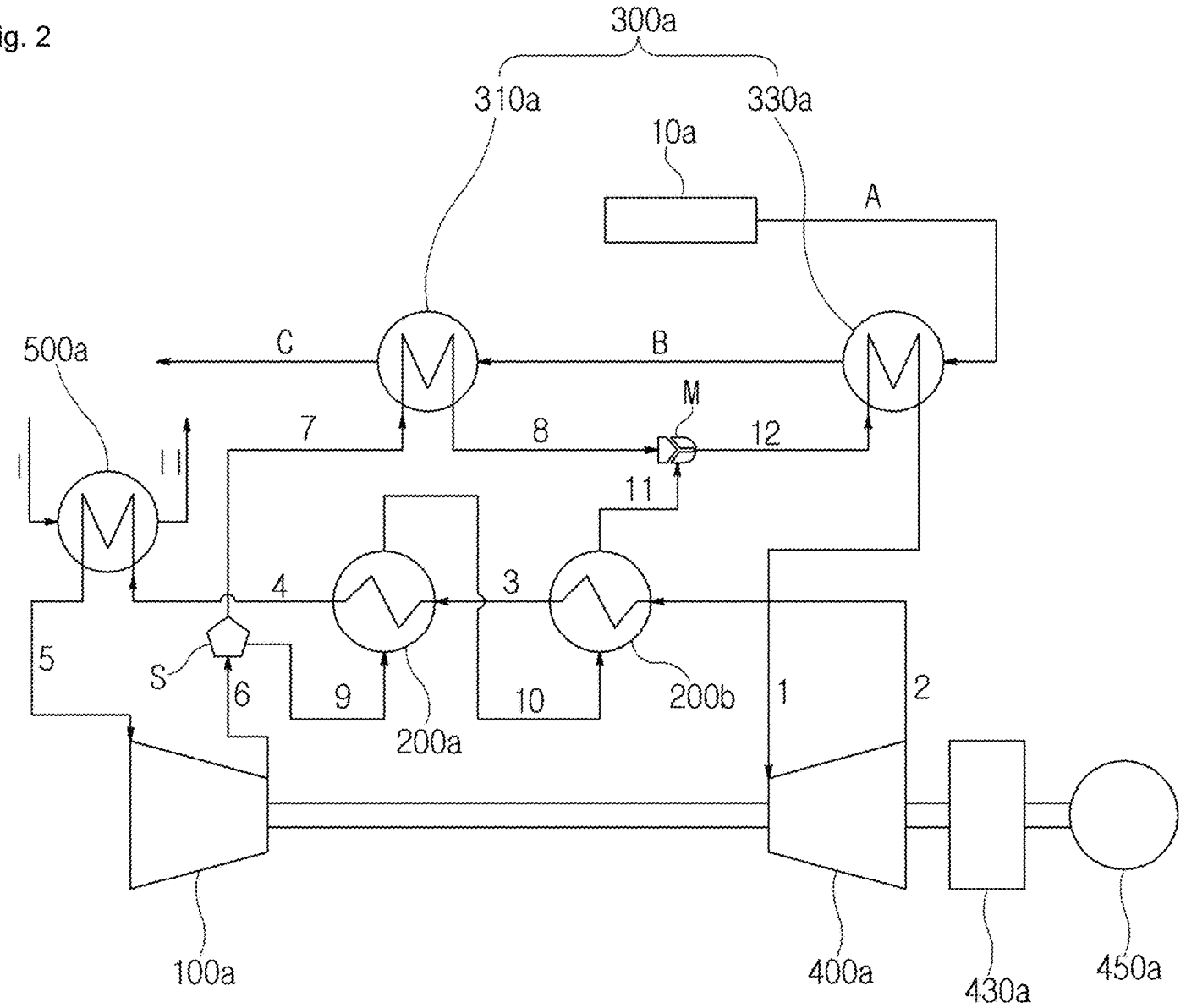
FIG. 2 is a schematic diagram illustrating a waste heat recovery power generation system according to another exemplary embodiment.

The power generation system using one recuperator is described above. Hereinafter, the power generation system using a plurality of recuperators will be described below (for convenience, the detailed description of the same configuration as the foregoing exemplary embodiment will be omitted). FIG. 2 is a schematic diagram illustrating a waste heat recovery power generation system according to an exemplary embodiment.

As illustrated in FIG. 2, the waste heat recovery power generation system according to another exemplary embodiment may include a first recuperator 200*a* into which a flow branched through the separator of a latter end of a compressor 100*a*, is introduced and a second recuperator 200*b* into which a flow passing through the first recuperator 200*a*.

The working fluid passing through the compressor 100*a* is branched from the separator S to be transferred to a first heat exchanger 310*a* or the first recuperator 200*a*.

The working fluid transferred (stream 7) to the first heat exchanger 310*a* exchanges heat with the waste heat gas to be primarily heated and then is supplied to the mixer M (stream 8) and the working fluid transferred (stream 9) to the first recuperator 200*a* exchanges heat with the working fluid passing through the turbine 400*a* and the second recuperator 200*b* to be primarily heated and then is transferred to the second recuperator 200*b* (stream 10). The working fluid secondarily heated by the second recuperator 200*b* is transferred to the mixer M (stream 11). The working fluids of streams Nos. 8 and 11 are mixed in the mixer M and then are transferred to the second heat exchanger 330*a* (stream 12) and the high temperature working fluid heated by exchanging heat with the waste heat gas in the second heat exchanger 330*a* is supplied to the turbine 400*a*.

The working fluid which passes through the turbine 400*a* and is in the expanded and middle temperature state is primarily cooled (streams Nos. 2 and 3) while sequentially passing through the second recuperator 200*b* and the first recuperator 200*a*. The cooled working fluid is transferred (stream 4) to the cooler 500 to be cooled at low temperature and is again supplied to the compressor 100*a*.

As such, the working fluid passing through the turbine 400*a* first passes through the second recuperator 200*b*, and therefore the second recuperator 200*b* becomes a high temperature recuperator and the first recuperator 200*a* becomes a low temperature recuperator.

When the plurality of recuperators are applied, the high temperature recuperator and the low temperature recuperator may use different materials, and therefore manufacturing costs may be reduced.

As described above, according to the waste heat recovery power generation system in accordance with the exemplary embodiment, it is possible to cope with the change in temperature and flow of the waste heat source without changing the overall flow of the system by controlling the branch amount of the working fluid branched from the latter end of the compressor to control the heat exchange amount of the waste heat recovery heater. Therefore, the waste heat recovery power generation system may be operated near the design point and therefore it is possible to constantly maintain the overall performance of the power generation system.

Meanwhile, the waste heat recovery power generation system according to the exemplary embodiment may be configured in the form in which the plurality of turbines are provided (the detailed description of the same configuration as the foregoing exemplary embodiments will be omitted).

Figure 6:
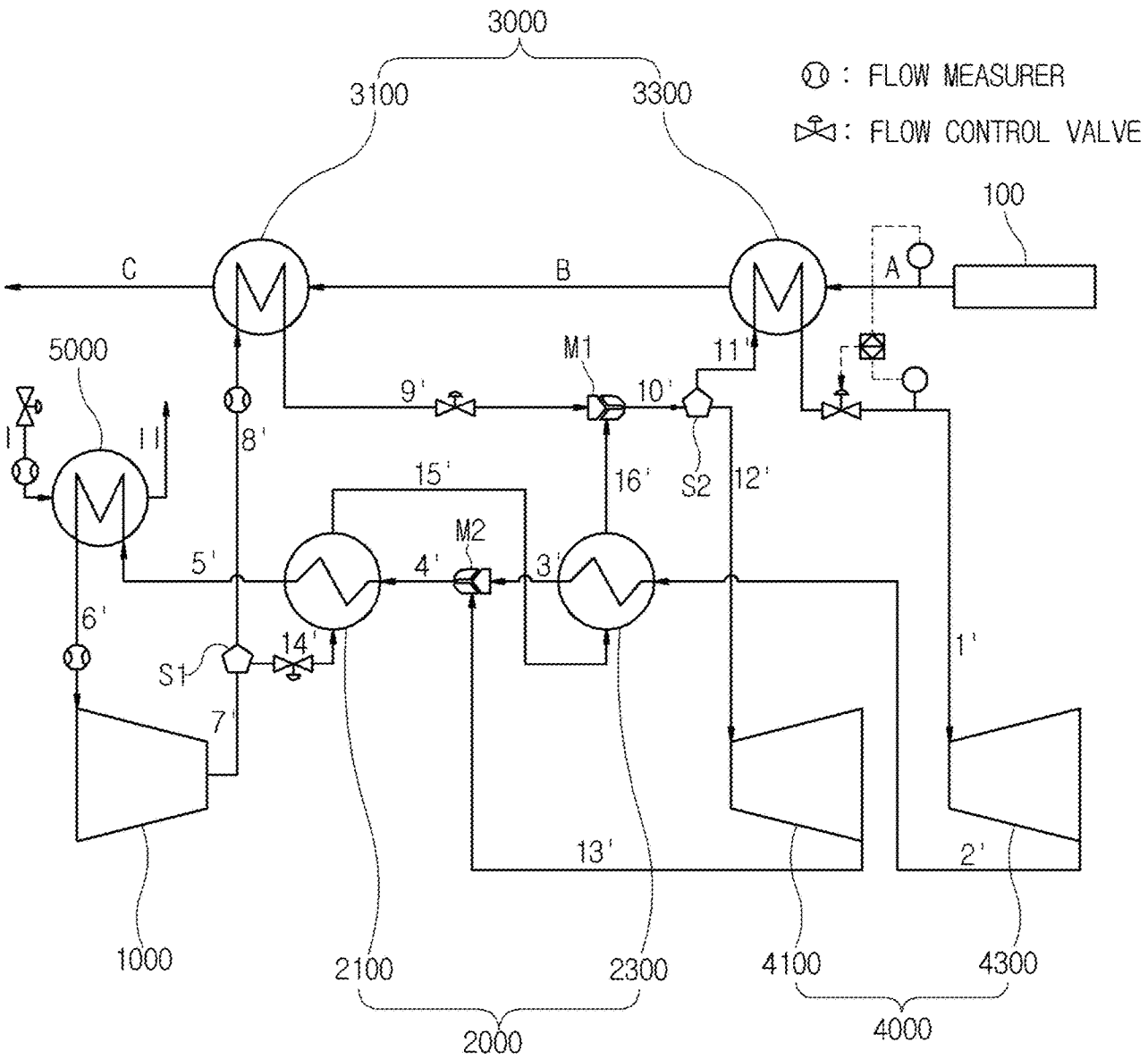
FIG. 6 is a schematic diagram illustrating a waste heat recovery power generation system according to another exemplary embodiment.
Figure 7:
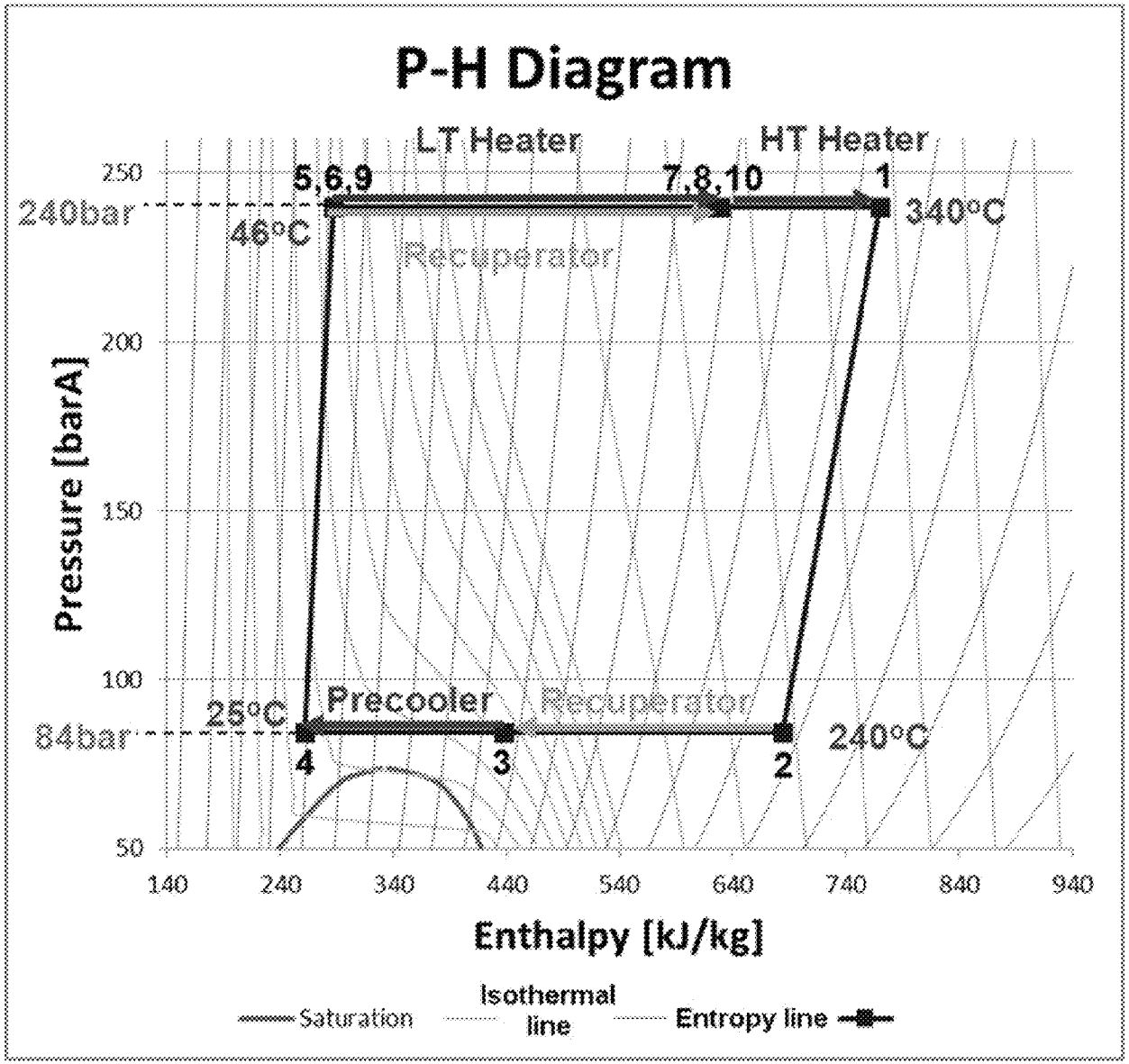
FIG. 7 is a pressure-enthalpy diagram of the existing power generation system using a single turbine.
Figure 8:
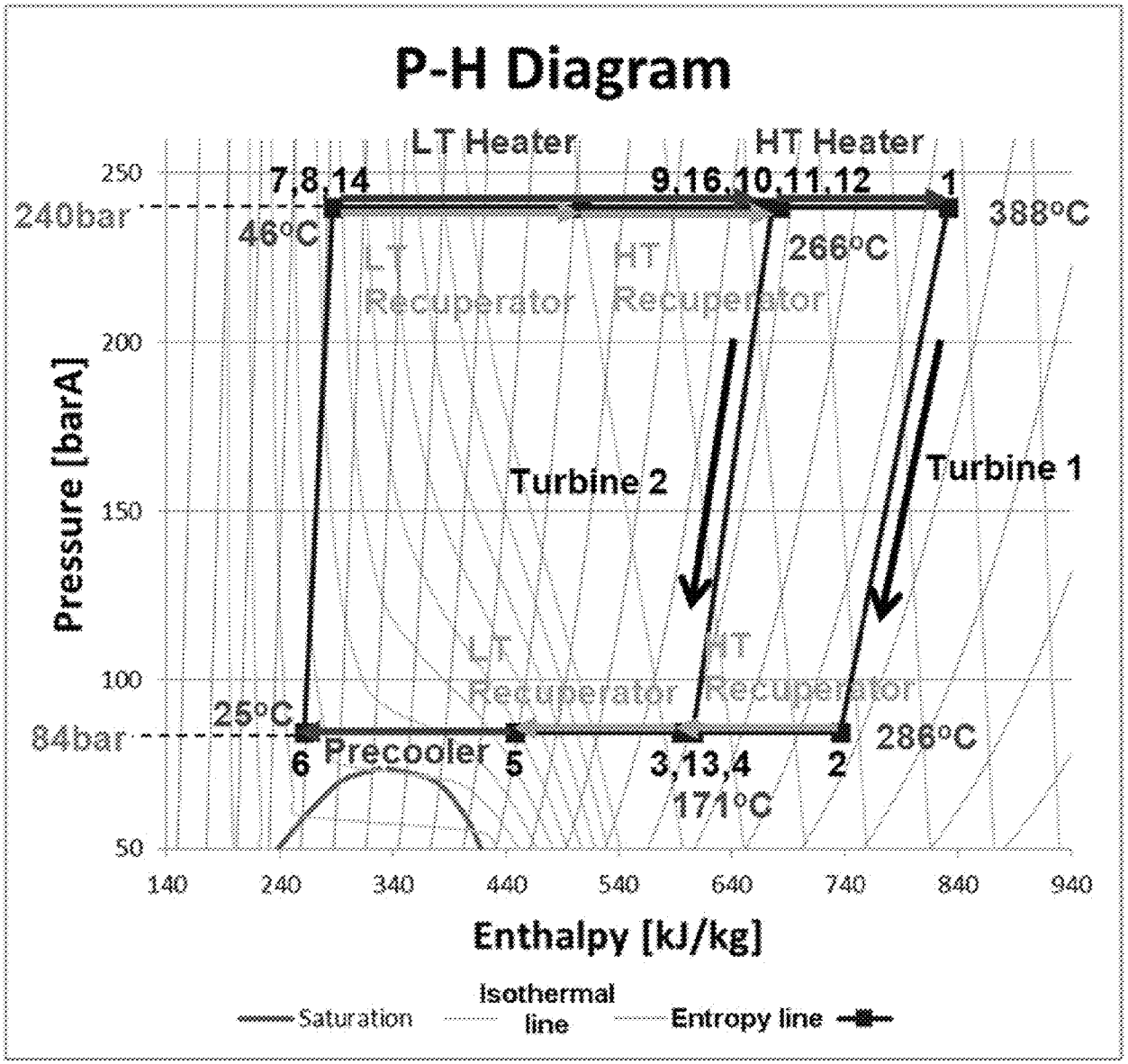
FIG. 8 is a pressure-enthalpy diagram of the waste heat recovery power generation system of FIG. 6.

FIG. 6 is a schematic diagram illustrating a waste heat recovery power generation system according to another exemplary embodiment, FIG. 7 is a pressure-enthalpy diagram of the existing power generation system using a single turbine, and FIG. 8 is a pressure-enthalpy diagram of the waste heat recovery power generation system of FIG. 6.

As illustrated in FIG. 6, a power generation system using supercritical $CO_2$ according to an exemplary embodiment uses the $CO_2$ as a working fluid and may be configured to include a compressor compressing the working fluid, a recuperator 2000 and a plurality of heat sources 3000 exchanging heat with the working fluid passing through the compressor 1000, a turbine 4000 driven by the working fluid heated by passing through a recuperator 2000 and the heat sources, a power generator 4500 driven by the turbine 4000, and a cooler 5000 cooling the working fluid introduced into the compressor 1000.

The recuperator 2000 is configured of a first recuperator 2100 and a second recuperator 2300, and the turbine 4000 may be configured of a low temperature first turbine 410 to which a relatively lower temperature working fluid is supplied and a second turbine 4300 to which a relatively higher temperature working fluid is supplied. The first turbine 4100 and the second turbine 4300 are installed in parallel with each other. Although not illustrated in the drawings, the second turbine 4000 is connected to the power generator to drive the power generator, thereby serving to produce power. Although not illustrated in the drawings, the second turbine 4300 is connected to the compressor 1000 to serve to drive the compressor 1000.

The mixer installed between a first heat exchanger 3100 and a second heat exchanger 3300 is a first mixer M1 and the mixer installed between the first recuperator 2100 and the second recuperator 2300 is a second mixer M2. The second mixer M2 mixes a working fluid (stream 3') passing through the first turbine 4100 and the second recuperator 2300 with a working fluid (stream 13') passing through the second turbine 4300 and the mixed working fluid is transferred (stream 4') to the first recuperator 2100.

A latter end of the compressor 1000 is provided with a first separator S1 for distributing a flow of the working fluid passing through the compressor 1000 into the first heat exchanger 3100 and the first recuperator 2100, respectively. Further, a second separator S is disposed between the first mixer M1 and the second heat exchanger 3300 to branch the flow of the working fluid mixed in the first mixer M1 into the second heat exchanger 3300 and the first turbine 4100.

In the waste heat recovery power generation system according to the exemplary embodiment having the foregoing configuration, a method for controlling a flow of a working fluid to cope with a change in temperature and flow of a waste heat source will be briefly described below.

The flow measurers for measuring a flow may each be installed at an inlet (stream 6') of the compressor 1000 and an introduction end (stream 8') of the first heat exchanger 3100 which is the low temperature heat source.

Further, the flow control valve may be installed at a front end (stream 9') of the first mixer M1 between the first heat exchanger 3100 and the high temperature second heat exchanger 3300 and may be installed between (stream 14') the first separator S1 and the first recuperator 2100.

The flow control valve installed at the stream 9' measures a temperature of a final outlet (C stream) of the heat source, and thus is open to maximally absorb heat depending on the measured temperature. That is, if the temperature of the C stream is higher than that of the emission regulation temperature, the flow control valve of the stream 9' is controlled to be open and thus the flow of the working fluid transferred to the first heat exchanger 3100 is increased, thereby reducing the temperature of the C stream. On the contrary, if the temperature of the C stream is lower than that of the emission regulation temperature, the flow control valve is controlled to be closed and thus the working fluid transferred to the first heat exchanger 3100 is cut off, thereby constantly maintaining the temperature of the C stream. By this process, the temperature of the C stream may be constantly maintained.

Further, the flow control valve is installed at the stream 9' to control the pressure of the valve, and as a result it is possible to prevent the working fluid of stream 16' from the second recuperator 2300 toward the first mixer M1 from reflowing in the stream 9'.

Meanwhile, the heat value supplied from the heat source is increased, and thus there may be the case in which the overall flow of the system needs to be increased.

In this case, the flow of the working fluids of streams Nos. 6 and 8 is measured and then the flow control valve of the stream 9' constantly maintains the temperature of the C stream. At the same time, the flow control valve installed at the stream 14' is open, and as a result the overall flow of the power generation system may be increased. The separate working fluid storage tank (not illustrated) is provided due to the insufficient flow of the working fluid and the working fluid is supplied from the storage tank into the power generation system as much as the insufficient flow.

On the contrary, the heat value supplied from the heat source is insufficient, and thus there may be the case in which the overall flow of the system needs to be decreased.

In this case, the flow of the working fluid of the stream 8' is measured and then the flow control valve of the stream 9' constantly maintains the temperature of the C stream. At the same time, the flow control valve installed at the stream 14' is closed, and as a result the overall flow of the power generation system may be decreased. To this end, although not illustrated in the drawings, a bypass valve is provided between an inlet and an outlet of the turbine 4000 and the bypass valve may be connected to the storage tank through the separate transfer tube. If the bypass valve is operated, the working fluid passing through the second heat exchanger 3300 is not transferred to the second turbine 4300 and may be recovered to the storage tank through the separate transfer tube.

In connection with the control of the flow of the working fluid as described above, to constantly maintain the temperature of the inlet of the compressor 1000, the flow of the cooler 5000 may also be controlled.

According to the present exemplary embodiment, upon abnormality or emergency of the components of the system, an example of controlling the flow of the working fluid to operate the power generation system will be described.

Figure 9:
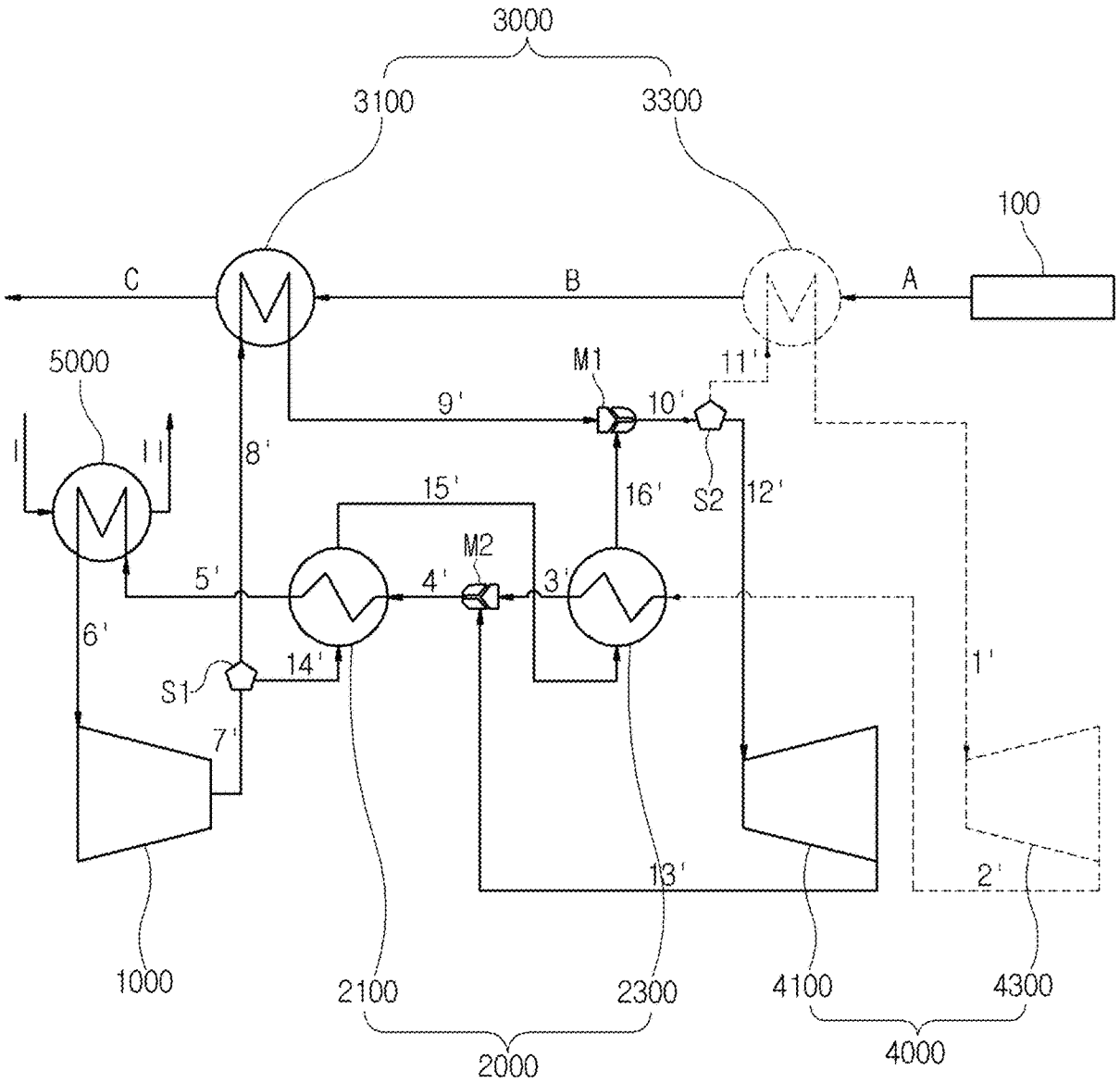
FIG. 9 is a schematic diagram illustrating a low temperature turbine only mode of the waste heat recovery power generation system of FIG. 6.

FIG. 9 is a schematic diagram illustrating a low temperature turbine only mode of the waste heat recovery power generation system of FIG. 6.

As illustrated in FIG. 9, when the first turbine 4100 is driven alone, the flow of the working fluid from the second separator S2 toward the stream 11 is cut off and thus the working fluid mixed in the first mixer M1 may be supplied only to the first turbine 4100.

Figure 10:
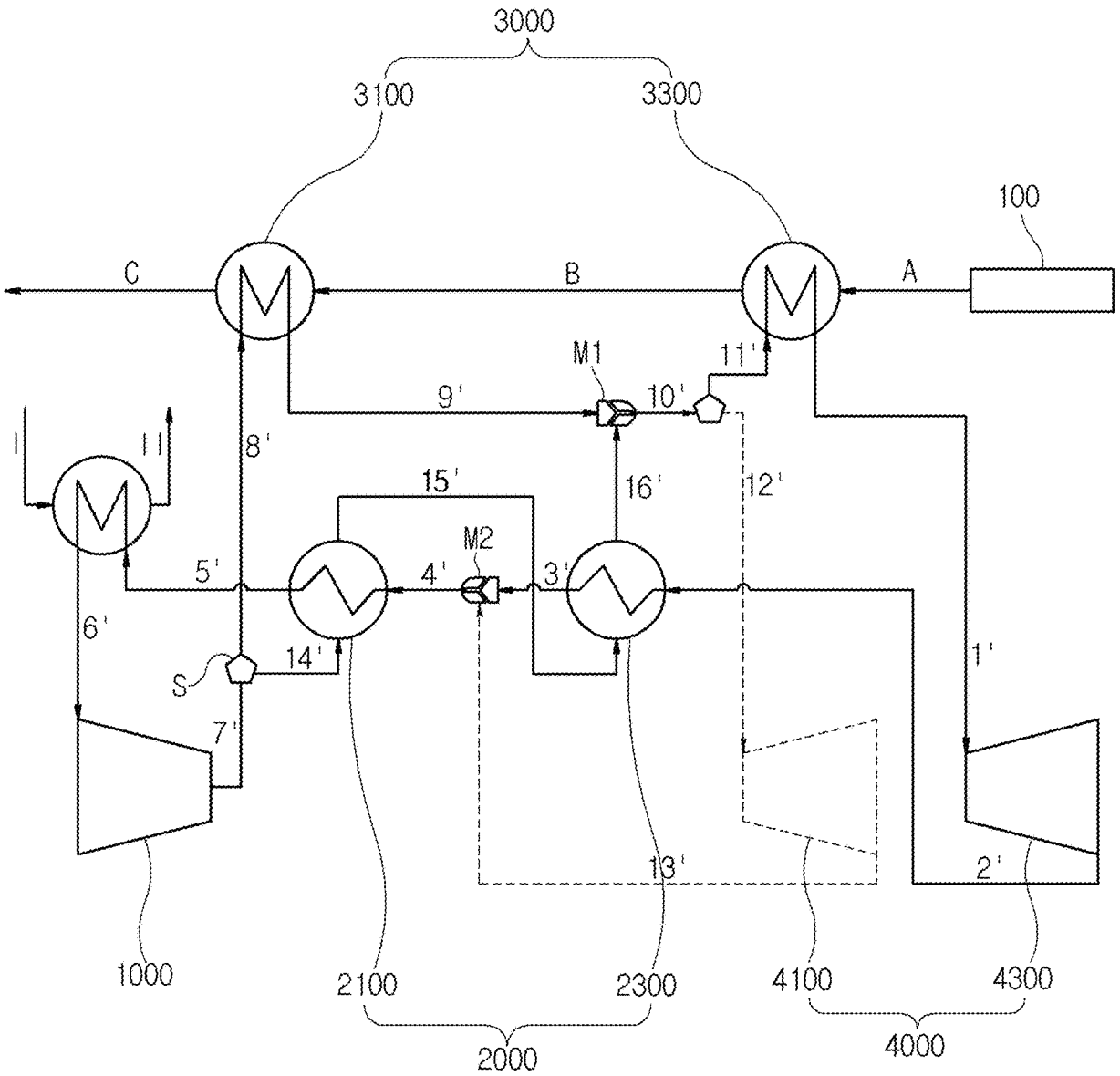
FIG. 10 is a schematic diagram illustrating a high temperature turbine driving only mode of the waste heat recovery power generation system of FIG. 6.

On the contrary, FIG. 10 is a schematic diagram illustrating a high temperature turbine driving only mode of the waste heat recovery power generation system of FIG. 6.

As illustrated in FIG. 10, when the second turbine 4300 is driven alone, the flow of the working fluid from the second separator S2 toward the stream 12 is cut off and thus the working fluid mixed in the first mixer M1 may be supplied only to the second turbine 4300. In this case, the second mixer M2 is not driven, and the working fluid passing through the second turbine 4300 is cooled by sequentially passing through the second recuperator 2300 and the first recuperator 2100 and then is transferred to the cooler 5000.

Figure 11:
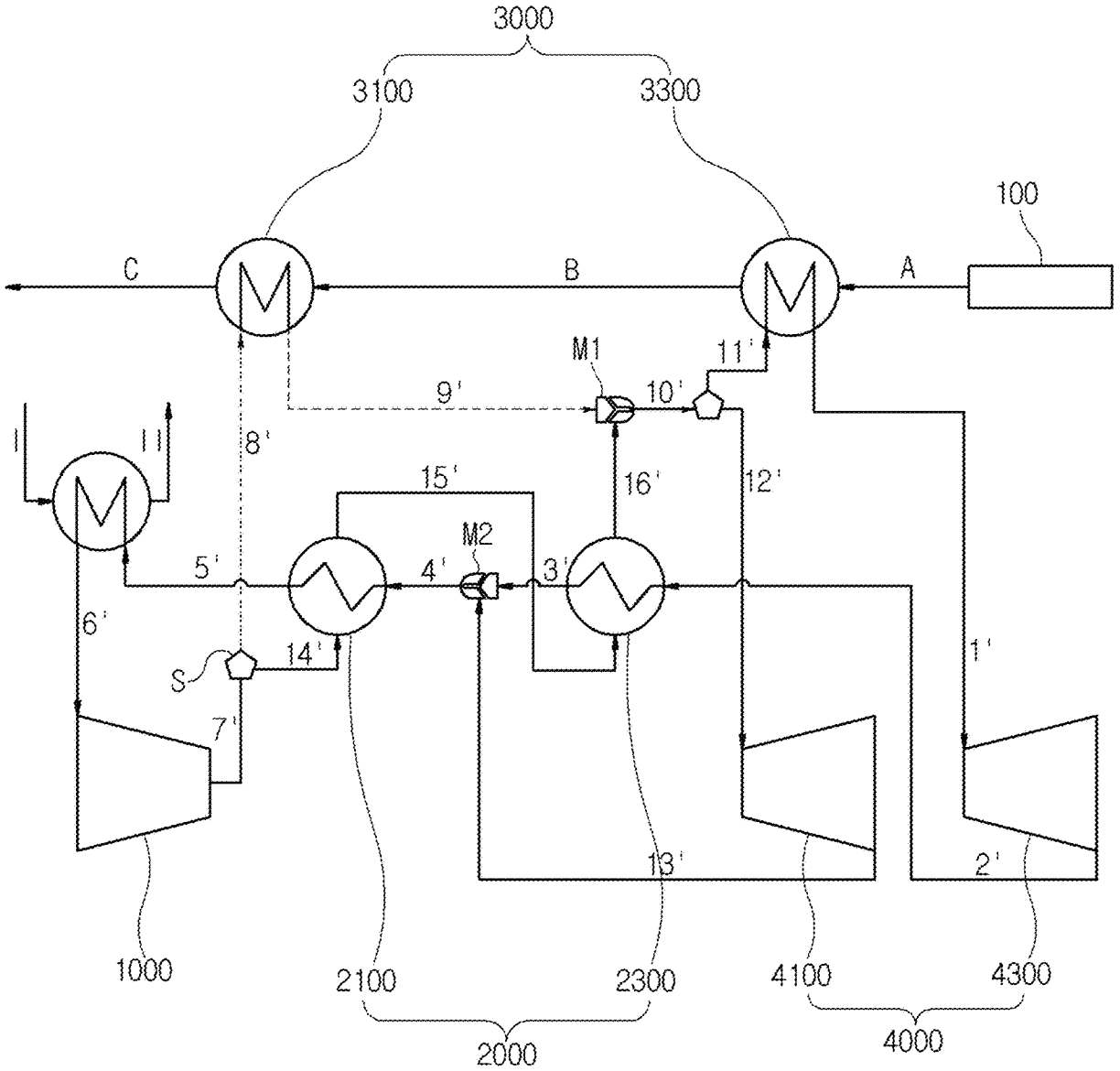
FIG. 11 is a schematic diagram illustrating a driving example when the low temperature waste heat recovery heater of the waste heat recovery power generation system of FIG. 6 fails.

FIG. 11 is a schematic diagram illustrating a driving example when the low temperature waste heat recovery heater of the waste heat recovery power generation system of FIG. 6 fails.

As illustrated in FIG. 11, when the first heat exchanger 3100 fails, the working fluid from the first separator S1 toward the stream 8 is cut off, and therefore the working fluid passing through the compressor 1000 may be supplied only to the stream 14 to drive only the second heat exchanger 3300, thereby operating the system. In this case, the first mixer M1 is not driven and the working fluid passing through the second recuperator 2300 is branched into the second heat exchanger 3300 and the first turbine 4100 through the second separator S2 and supplied.

Figure 12:
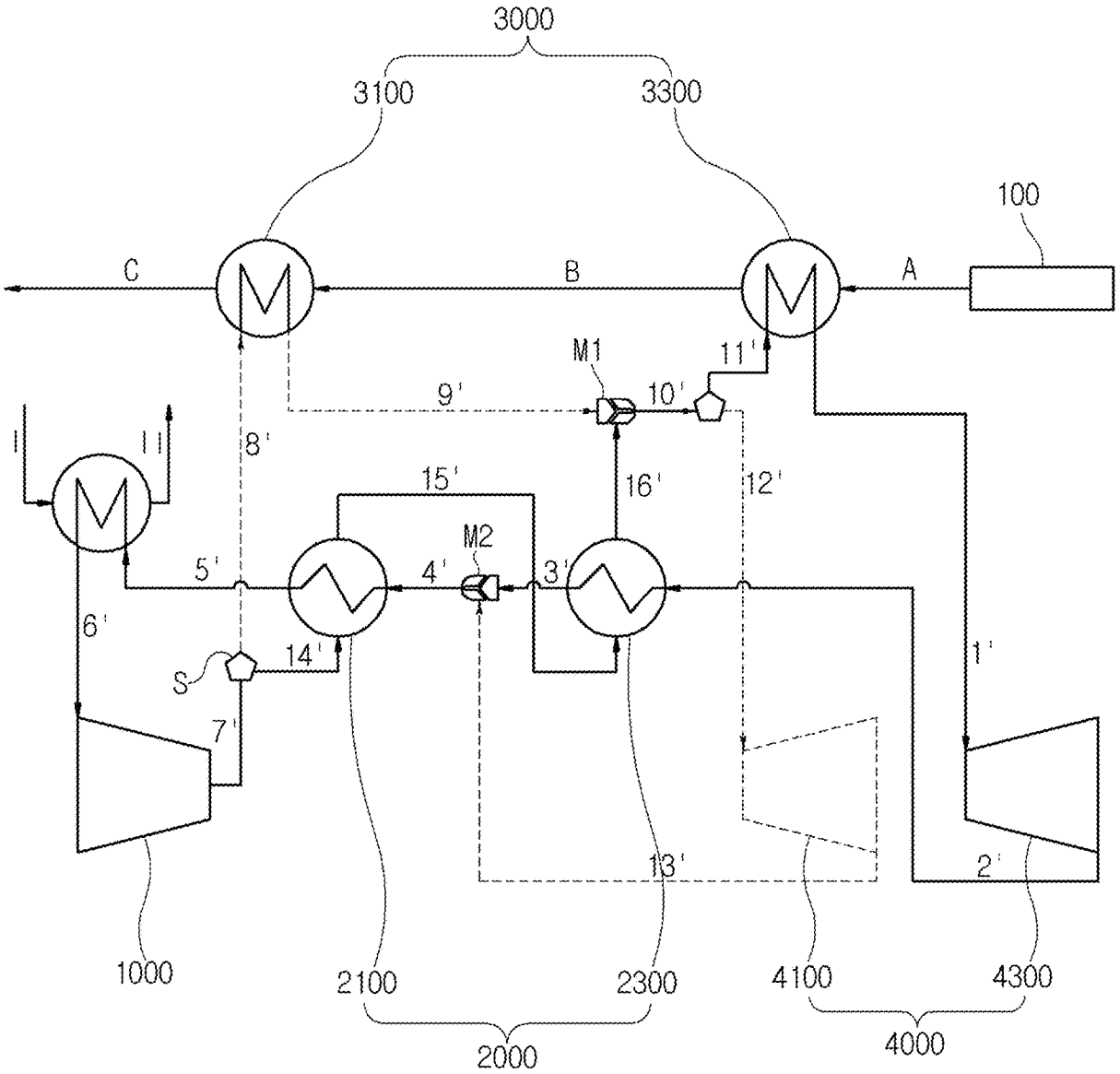
FIG. 12 is a schematic diagram illustrating another driving example when the low temperature waste heat recovery heater of the waste heat recovery power generation system of FIG. 6 fails.

FIG. 12 is a schematic diagram illustrating another driving example when the low temperature waste heat recovery heater of the waste heat recovery power generation system of FIG. 6 fails.

As illustrated in FIG. 12, when the first heat exchanger 3100 fails, even the first turbine 4100 is not driven and only the second turbine 4300 is driven, thereby operating the system. That is, the working fluid from the first separator S1 toward the stream 8 is cut off and thus the working fluid passing through the compressor 1000 is supplied only to the stream 14, such that only the second heat exchanger 3300 may be driven. In this case, the first mixer M1 is not driven, and the working fluid from the second separator S2 toward the stream 12 may be cut off to prevent the driving of the first turbine 4100. Therefore, the working fluid passing through the second recuperator 2300 is supplied to the second heat exchanger 3300 through the first mixer M1 and the second separator S2 and then is transferred to the high temperature second turbine 4300. Since the driving of the first turbine 4100 is in a stop state, the second mixer M2 is not driven as well, and the working fluid passing through the second turbine 4300 is cooled by sequentially passing through the second recuperator 2300 and the first recuperator 2100 and then is transferred to the cooler 5000.

As set forth above, the waste heat recovery power generation system according to the exemplary embodiments may be operated near the design point to constantly maintain the overall performance of the power generation system and includes the two parallel turbines to more improve the efficiency of the system and the overall output of the turbine than the case in which one turbine is used.

According to the waste heat recovery power generation system and the flow control method in accordance with the exemplary embodiment, it is possible to cope with the change in temperature and flow of the waste heat source without changing the overall flow of the system by controlling the branch amount of the working fluid branched from the latter end of the compressor to control the heat exchange amount of the waste heat recovery heater. Therefore, the waste heat recovery power generation system may be operated near the design point and therefore it is possible to constantly maintain the overall performance of the power generation system.

The various exemplary embodiments of the disclosure, which are described as above and shown in the drawings, should not be interpreted as limiting the technical spirit of the inventive concept. The scope of the inventive concept is limited only by matters set forth in the claims and those skilled in the art can modify and change the technical subjects of the disclosure in various forms. Therefore, as long as these improvements and changes are apparent to those skilled in the art, they are included in the protective scope of the inventive concept.

What is claimed is:

1. A waste heat recovery power generation system, comprising:

a compressor configured to compress a working fluid, an output fluid of the compressor branched into a first output fluid and a second output fluid of the compressor;

a heat exchanger configured to recover waste heat from waste heat gas supplied from a waste heat source, the recovered waste heat heating the working fluid, the heat exchanger comprising:

a first heat exchanger receiving the first output fluid and including a working fluid outlet for passing the received first output fluid, the first heat exchanger further including a final outlet from which the waste heat gas exits the first heat exchanger; and a second heat exchanger including a working fluid inlet for receiving the first output fluid passed by the working fluid outlet of the first heat exchanger, the second heat exchanger further including a working fluid outlet for passing the working fluid received at the working fluid inlet of the second heat exchanger;

a turbine configured to be driven by the working fluid heated by the recovered waste heat, the turbine including an inlet for receiving the working fluid passed by the working fluid outlet of the second heat exchanger;

a recuperator configured to exchange heat between an output fluid of the turbine and the output fluid of the compressor to cool the output fluid of the turbine;

a first flow control valve including a valve portion, the first flow control valve is controlled based on a measured temperature of the waste heat gas (C stream) exiting the final outlet of the first heat exchanger relative to a maximum emission temperature of a preset emission regulation condition, the valve portion coupled to the working fluid outlet of the first heat exchanger and provided between the first and second heat exchangers; and a first mixer including a first inlet receiving the first output fluid from the working fluid outlet of the first heat exchanger through the first flow control valve, a second inlet receiving the second output fluid passing through the recuperator, and an outlet for passing a mixture of the first and second output fluids to the second heat exchanger and the turbine, wherein the first flow control valve is further configured to change an amount of flow of the first output fluid to the first inlet of the first mixer based on the measured temperature such that the first flow control valve is open if the measured temperature exceeds the maximum emission temperature and is closed if the measured temperature does not exceed the maximum emission temperature.

2. The waste heat recovery power generation system of claim 1, wherein the first heat exchanger is disposed at a low temperature side of the heat exchanger to receive the first output fluid of the compressor, and wherein the second heat exchanger is disposed at a high temperature side of the heat exchanger to receive the waste heat gas from the waste heat source and to pass the received waste heat gas to the first heat exchanger in order to exit the first heat exchanger through the final outlet.

3. The waste heat recovery power generation system of claim 2, wherein the first output fluid branched from the output fluid of the compressor is transferred to the first heat exchanger, wherein the second output fluid branched from the output fluid of the compressor is transferred to the recuperator, and wherein the second output fluid passing through the recuperator is transferred to the second heat exchanger.

4. The waste heat recovery power generation system of claim 3, further comprising:

a first separator configured to be disposed at a downstream side of the compressor and configured to branch the output fluid of the compressor into the first output fluid and the second output fluid of the compressor, wherein the output fluid of the first heat exchanger is joined with the second output fluid passing through the recuperator at an upstream side of the second heat exchanger.

5. The waste heat recovery power generation system of claim 4, wherein the recuperator comprises:

a first recuperator; and a second recuperator, wherein the second recuperator comprises a high temperature recuperator configured to receive the output fluid of the turbine, and wherein the first recuperator comprises a low temperature recuperator configured to receive an output fluid of the second recuperator and further comprises an inlet receiving the second output fluid from the first separator.

6. The waste heat recovery power generation system of claim 5, wherein the first recuperator is configured to receive the second output fluid of the compressor and wherein the output fluid of the first heat exchanger is joined with the second output fluid passing through the second recuperator at an upstream side of the second heat exchanger.

7. The waste heat recovery power generation system of claim 6, further comprising:

a second mixer disposed between the first recuperator and the second recuperator, the second mixer including a first inlet receiving the output fluid from the second recuperator, a second inlet receiving a third output fluid from the turbine, and an outlet for passing to the first separator a mixture of the output fluid from the second recuperator and the third output fluid from the turbine; and a second separator disposed between the outlet of the first mixer and the working fluid inlet of the second heat exchanger and configured to branch an output fluid of the first mixer into the third output fluid and a fourth output fluid, the branched fourth output fluid provided to the working fluid inlet of the second heat exchanger.

8. The waste heat recovery power generation system of claim 7, wherein the turbine comprises:

a first turbine configured to receive the third output fluid from the second separator; and a second turbine connected in parallel with the first turbine and configured to receive an output fluid of the second heat exchanger, and wherein a temperature of the third output fluid transferred to the first turbine is lower than a temperature of the output fluid of the second heat exchanger transferred to the second turbine.

9. The waste heat recovery power generation system of claim 8, wherein the third output fluid passing through the first turbine is introduced into the second mixer, and wherein the output fluid of the second heat exchanger passing through the second turbine is mixed with the third output fluid passing through the first turbine from the second mixer through second recuperator and then is transferred to the first recuperator.

10. The waste heat recovery power generation system of claim 9, further comprising:

a storage tank configured to supply an additional working fluid; and a flow measurer is disposed at an upstream side of the compressor and an upstream side of the first heat exchanger.

11. The waste heat recovery power generation system of claim 1, further comprising:

a power generator connected to the turbine and configured to produce power; and a gear box disposed between the turbine and the power generator, configured to change an output of the turbine according to an output frequency of the power generator and configured to transfer the output of the turbine to the power generator, wherein the turbine and the compressor are connected coaxially, and wherein the compressor and the power generator are driven by the turbine.

12. The waste heat recovery power generation system of claim 1, further comprising:

a first separator configured to be disposed at a downstream side of the compressor and configured to branch the output fluid of the compressor into the first output fluid and the second output fluid of the compressor; and a second flow control valve provided between the first separator and the first mixer, wherein the second flow control valve is configured to control an overall amount of working fluid.

13. The waste heat recovery power generation system of claim 12, wherein the first and second flow control valves are configured to control an amount of the working fluid entering the second heat exchanger from the compressor and the recuperator to minimize a temperature difference of the working fluid between the first heat exchanger and the second heat exchanger.

* * * * *